US005976635A

United States Patent [19]

Kinnunen

[11] Patent Number: 5,976,635

[45] Date of Patent: Nov. 2, 1999

[54] METHOD FOR COATING A PAPER OR BOARD WEB

[75] Inventor: Jorma Kinnunen, Järvenpää , Finland

[73] Assignee: Valmet Corporation, Helsinki, Finland

[21] Appl. No.: 08/933,264

[22] Filed: Sep. 18, 1997

Related U.S. Application Data

[63] Continuation of application No. 08/486,603, Jun. 7, 1995, abandoned.

[30] Foreign Application Priority Data

Jun. 17, 1994 [FI] Finland ..... 942926

[51] Int. Cl.[6] ..... B05D 1/40

[52] U.S. Cl. ..... 427/477; 427/255.5; 427/424; 427/478; 427/482; 427/600

[58] Field of Search ..... 427/475, 600, 427/601, 477, 478, 482, 255.5, 424

[56] References Cited

U.S. PATENT DOCUMENTS

| | | | |
|---|---|---|---|
| 5,024,856 | 6/1991 | Hohnerlein | 427/600 |
| 5,540,384 | 7/1996 | Erickson et al. | 239/102.2 |
| 5,582,348 | 12/1996 | Erickson et al. | 239/4 |

*Primary Examiner*—Bernard Pianalto
*Attorney, Agent, or Firm*—Cohen, Pontani, Lieberman & Pavane

[57] ABSTRACT

A method for coating a paper or board web or the like (7) using a coating mix aerosol generated by means of an ultrasonic atomizer. The output power of a plurality of ultrasonic transducers (15) disposed proximate to a surface of the moving web (7) is passed via a vibrated beam (14) to a coating mix flow (2) flowing proximate to the web (5). Ultrasonic vibrations applied to the coating mix atomize the upper layer of the coating mix flow into an aerosol (11) which is emitted toward the web (7) and adheres thereto.

12 Claims, 1 Drawing Sheet

METHOD FOR COATING A PAPER OR BOARD WEB

This is a Continuation of application Ser. No. 08/486,603, filed Jun. 7, 1995, abandoned.

FIELD OF THE INVENTION

The present invention relates to a method and apparatus for coating a paper or board web or the like by an aerosol generated with the aid of an ultrasonic atomizer.

The invention also concerns an apparatus according to the preamble of claim 8 based on the principle of the method.

The invention further concerns an atomizer suited for use in conjunction with the method and the assembly.

BACKGROUND OF THE INVENTION

The quality of paper or board can be improved by, among other ways, coating the paper or board web with a suitable coating mix. The coat is most commonly applied using brush applicators, nozzle applicators and for short-dwell coaters, all of which are combined with an almost simultaneous control of coat thickness by means of a doctor blade. These methods all employ a narrow slit formed proximate to the moving web, whereby the amount of applied coat is controlled by the slit. The final control of the coat weight may be performed in a number of different manners. Using the above-mentioned methods under conditions optimized for each method, a good coat quality can be attained at relatively high web speeds. However, running the web at a speed above a certain limit may be difficult due to a number of reasons. During application, the web is subjected to a relatively severe strain, which, particularly at high web speeds, readily causes web breakages. During coat application, the web is slightly elongated by the tensional strain and increased moisture content, whereby such elongation must be managed by the drive control system of the paper machine. Another shortcoming of conventional coaters in application at high web speeds is the uncontrolled flow of the coating mix at the instant of application resulting in uneven coat smoothing, which can be seen as blots and streaks on the web and as splashing around the machine. The severe strain imposed on the web during doctor blade coating causes a coating problem.

Because industry demand is for paper making machinery operating at higher web speeds, novel methods must be developed for the application of coating mix onto the web surface. One of these new methods is spray-coating in which the coating mix is blown from spray nozzles onto the web. One form of spray-coating is ultrasonic coating in which the coating mix is atomized into small droplets with the help of ultrasonic energy and the droplets are guided to hit the web surface chiefly ejected by the ultrasonic atomizer. Alternatively, ultrasonic energy can be used merely for atomizing the coating mix into droplets. The principal benefit of ultrasonic coating is that an extremely small droplet size can be achieved, whereby the applied coat becomes homogeneous and no mechanical doctoring gap for coat weight control is required in the vicinity of the web. The ultrasonic nozzle has a nozzle channel ending at the nozzle tip surface, and the material to be atomized is fed into the channel. Piezoelectric elements are adapted about this tubular part, emitting ultrasonic vibrations capable of atomizing the material to be spray-coated into an aerosol.

Wider use of ultrasonic coating has been limited by the lack of sufficient atomizing output power in commercially available ultrasonic nozzles. For instance, if it is desired to coat the web with an amount of coating mix that results in 10 $g/m^2$ dry coat weight, the amount of coating mix applied onto each linear meter of a web running at 30 m/s must be 600 $gs^{-1}m^{-1}$ when the coating mix contains 50% solids. Then, the required ultrasonic atomizing effect is 1000–3000 $gs^{-1}m^{-1}$. However, the output power of conventional ultrasonic nozzles is so low that the required number of nozzles readily becomes very high if the web speed and amount of applied coat is increased. This type of nozzle makes it difficult to achieve high-speed application onto a narrow area which would be advantageous in terms of minimal moisture absorption into the web. Nozzles with a circular orifice are also hampered by their spot-shaped hit area of the atomized droplets which makes it difficult to achieve a homogeneous coat as the hit areas of the nozzles cannot be merged with each other in a seamless manner. Difficult-to-pump mixes, for example, high-viscosity coatings are also difficult to atomize by means of conventional ultrasonic nozzles.

SUMMARY OF THE INVENTION

It is an object of the present invention to achieve a method for applying a coat to a paper or board web based on ultrasonic atomization of the coating mix.

The goal of the present invention is accomplished by applying the output energy of a plurality of ultrasonic transducers by means of a vibrated beam to a coating mix flow passing close to the web surface, whereby the ultrasonic energy is transmitted to the coating mix so as to atomize the upper layer of the coating mix flow into an aerosol which is emitted toward and deposited on the moving web.

The invention offers significant benefits.

Ultrasonic atomization makes it possible to achieve an extremely small aerosol droplet size and homogeneous size distribution of the droplets. The use of the vibrated atomizer beam according to the present invention achieves a smooth coat thickness over the width of the web, and moreover, permits profile control of the amount of applied coat. The droplet size can be controlled by varying the ultrasonic frequency, and the coat weight can be easily controlled by altering the thickness of the atomized coating flow and its distance from the web. An electric field may be readily applied between the coat mix flow and the web, thereby enhancing the transfer of the droplets onto the web. A number of vibrated atomizer beams can be employ within a relatively narrow application zone, whereby a sufficient atomizing energy density and amount of atomized coating mix is provided. Excess aerosol is easy to recover as the air layer travelling along with the running web forces the excess aerosol back to the coating mix flow. With regard to its mechanical construction, the applicator apparatus according to the present invention is extremely simple compared with conventional coaters as it requires no complex end seals, heavy framework or complex control arrangements. In its simplest embodiment, the only moving parts of the apparatus comprise elements for adjusting the distance between the surface of the coating mix flow and the web.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
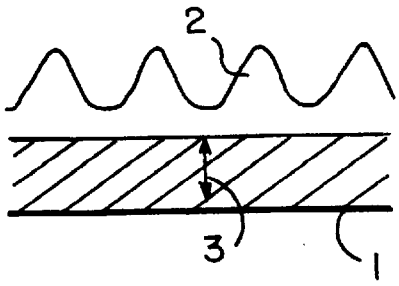
FIGS. 1 and 2 are conceptual drawings illustrating the formation of droplets from the coating mix flow.
Figure 2:
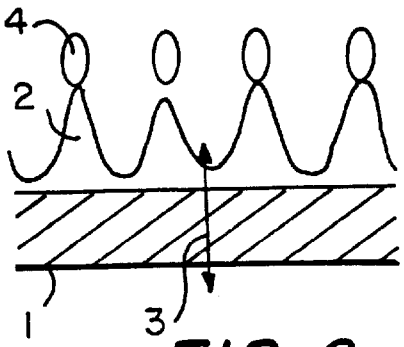

The generation of the coating mix aerosol is based on the principlie illustrated in FIGS. 1 and 2. When a fluid layer 2 is admitted onto a substrate 1 and the substrate 1 is made to oscillate in the direction of arrow 3, waves are generated on the fluid surface by the energy of the oscillations. When the energy input is increased, the waves are broken at their tops so as to form droplets 4. The quantity and size of the generated droplets 4 are affected by, among other things, the energy level used, the oscillation frequency and the thickness of the fluid layer. Fluids of different properties behave differently under vibration, and hence, the optimal atomizing parameters must be determined separately for each desired droplet size and amount of aerosol generated. A higher oscillation frequency reduces the droplet size. At 50 kHz, the droplet size for water is in the order of 30–60 $\mu$m.

Figure 3:
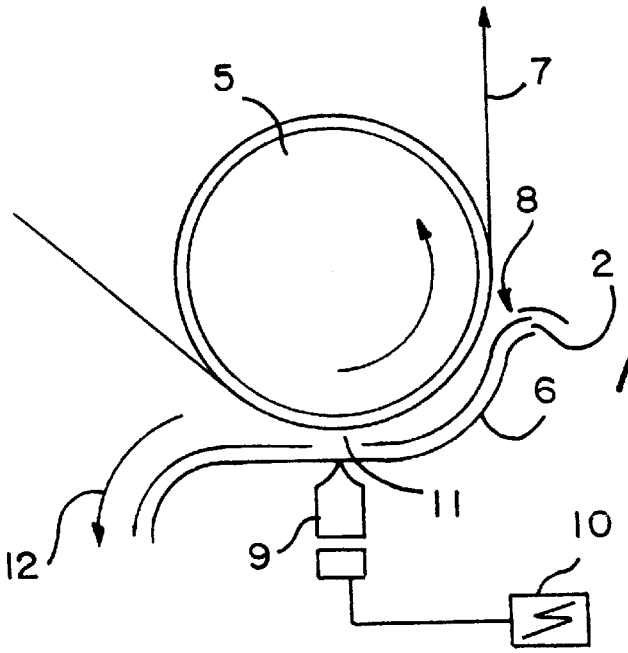
FIG. 3 is a schematic drawing of an applicator apparatus according to the present invention.

Referring to the embodiment of the present invention shown in FIG. 3, the aerosol is generated by a plate 6 disposed close a backing roll 5. The web 7 to be coated is passed in the direction of the arrow over the backing roll 5. The atomizing plate 6 is shaped compliant with the roll 5 so that, approximately at the point where the web 7 leaves the roll 5, an elongated nozzle slit 8 is positioned from which the atomizing plate 6 extends in a direction opposite to the rotational direction of the roll 5 and the travel direction of the web 7. The portion of the plate 6 is contoured to substantially correspond to the surface of the roll 5 and is disposed a distance away from the rolls. Another portion of the plate 6 is continued as a horizontal surface which is parallel to a tangent of the roll 5. Alternatively, the plate 6 may be contoured to follow the surface of the roll 5. The planar portion of the plate is disposed relatively close to the backing roll 5 and the web 7, and an ultrasonic transducer 9 is mounted to the backside of the plate 6. The ultrasonic transducer 9 is mounted onto the plate 6 at the point where the planar portion of the plate is closest to the web 7, and the transducer is connected to an adjustable source 10 of AC energy. Finally, after the planar portion the plate is deflected downward.

In operation coating mix is fed via the slit 8 onto the plate 6, on which the mix passes in a thin, laminar flow onto the planar portion of the plate 6. As the coating mix flow reaches the portion to which the transducer 9 is attached, the energy of oscillations atomizes a portion of the coating mix in an aerosol zone II and a portion of the atomized aerosol adheres to the passing web 7. The excess aerosol is carried along with the air layer travelling with the web 7 and impinges on the coating mix flow 2 passing over the plate 6 in the region where the plate 6 is deflected closer to the backing roll 5. The nozzle slit or feed orifice 8 of the coating mix is positioned close to the surface of the web 7 to minimize the amount of aerosol that can escape to the surroundings through the gap between the coating mix flow 2 and the web 7. That portion of the coating mix which is not atomized in aerosol zone II returns after filtering back to the coating mix circulation as indicated by arrow 12. The amount of coating mix adhering to the web 7 is dependent on the transducer energy input and the distance between the coating mix flow 2 and the web 7. Upon application of higher energy, the portion of atomized mix will increase, and more coat will adhere to the web 7. Besides controlling the amount of coating mix adhering to the web, the distance between the coating mix flow 2 and the web 7 affects the aerosol zone 11 formed at the atomizer 9 that is equivalent to the application zone of conventional coaters. The volume of coating applied at the aerosol zone is also dependent on the amount and speed of air travelling along with the web, and a number of other factors. The distance between the coating mix flow and the web is preferably adjustable, and the distance adjustment range should be at least from 10 to 100 mm. According to currently available experience, the distance is advantageously adjustable in the range of 15–25 mm. The atomizer output power should be sufficiently high, and the required power level increased in proportion to the higher web speeds and amounts of applied coat. Additionally, the required power level is affected by the viscosity and solids content of the coating paste. To atomize conventional coating mixes, the atomizer output power must be at least 2000–5000 W per linear meter. The ultrasonic frequency is normally advantageously in the range 25–60 kHz, while for a higher-viscosity coating mix the frequency must be dropped to the range of 10–30 kHz to generate larger droplets. These limits are here only mentioned as advantageous values of the embodiment and they should be understood to be varied widely as required by the implementation of the method and the desired end result.

Figure 4:
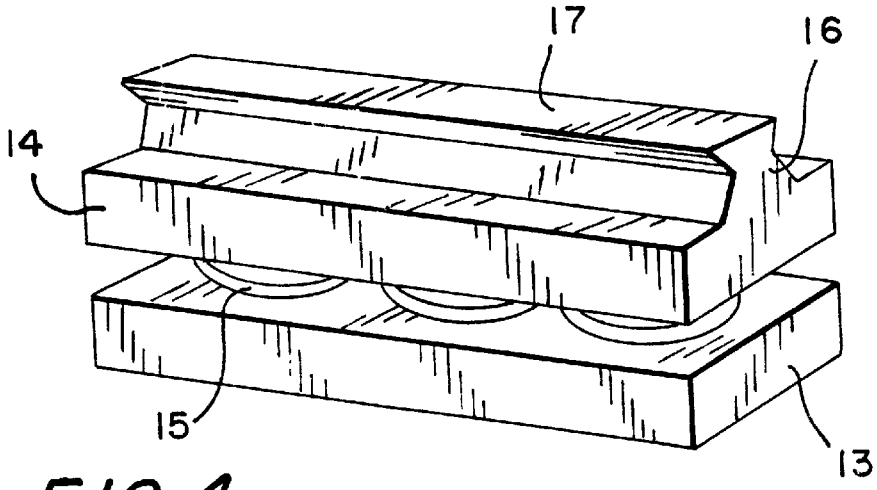
FIG. 4 is a perspective view of an atomizer in accordance with the present invention.

Now referring to FIG. 4, an atomizer 9 according to the present invention is shown therein. This type of atomizer 9 is best suited for use in conjunction with the method and coater apparatus described above, while the method and apparatus according to the present invention may also be implemented using other types of ultrasonic oscillators. In the above-described type of apparatus, the ultrasonic energy must be applied to the coating mix at a narrow, elongated area extending over the entire width of the web 7. This requirement is fulfilled by means of an atomizer comprising two beams 13, 14 and a number of piezoelectric transducer elements 15 positioned between the beams 13, 14. One of the beams acts as a transducer support beam 13, which provides a mounting platform for the transducer elements 15. The other sides of the transducer elements 15 are attached to the vibrated beam 14. The top surface of the vibrated beam 14 carries an amplitude matching element 16 with an hour-glass cross section that first tapers and then flares into an atomizer surface 17 which is attached to the ultrasonically excited end element such as a plate 6, for instance. While the atomizer illustrated in FIG. 3 has only three transducer elements 15, an atomizer 9 of for use with a paper coater would preferably have a significantly larger number elements because the atomizer must extend over the entire cross-machine width. Alternatively, a plurality of shorter abutted atomizer modules may be used. Furthermore, several atomizer modules may be placed adjacent to each other in the machine direction of the web, whereby the modules form an atomizing zone over which the coating mix is atomized. The number of adjacent atomizer modules is selected according to the desired ultrasonic output power. Using such an array of atomizer modules, the output power of multiple atomizer modules can be transmitted to the atomizing or vibrating surface 17 and the power density over the surface can be equalized. Furthermore, the fabrication of such atomizer modules is easier than the adaptation of the amplitude matching elements to the singular transducer elements and then attaching the matching elements to the vibrated member.

Besides those described above, the present invention may have alternative embodiments.

The shape of the atomizing plate 6 and its position relative to the backing roll 5 may be varied widely. The atomizing action need not necessarily occur from a horizontally aligned surface, but instead, the atomizing surface may be tilted also at areas facing the backing roll 5. However, the surface must be at such an angle that it can support a steady flow of coating mix. Instead of the narrow orifice 8 mentioned above, the coating mix may be fed onto the atomizing area using a plurality of different methods. An advantageous arrangement could comprise overflow of the coating mix over a weir. The overflow could also be arranged so that the atomizing surface is provided with a threshold just prior to the atomizing area, whereby the thickness or depth of the coating mix flow entering the atomizing area could be metered very accurately. In this case the simplest form of the atomizing plate comprises a mere elongated surface extending over the cross-machine width of the web and having a machine-direction width equal to the atomizing area. The actual metering of the coating mix could be implemented with the help of an overflow weir placed at the edge of a coating mix metering tray. The application of the coating mix could also be made onto a straight-running web not supported by a backing roll, but this method might be hampered by web vibrations and deflections impairing the coat quality and by the air layer travelling along with the fast moving web which imparts a pressure impact effect in the gap between the applicator apparatus and the web. In this kind of arrangement, the web could be supported by a wire.

As the application of the coating mix according to the present invention occurs by aerosol deposition, special care must preferably be taken to prevent the aerosol from reaching the surrounding environment. In the machine direction, the aerosol can be collected into the coating mix flowing to the application zone by adapting the coating mix to flow at a distance close to the moving web after the actual application zone. This gap may additionally be provided with a slight overpressure by means of air injection to prevent the aerosol from escaping from the applicator. At the outgoing side of the web, the outflow of the aerosol can be prevented either in the above-described manner by means of the air layer conveyed by the web, or alternatively, using a narrow gap and injected air, whereby the entry of the air conveyed by the web to the atomizing zone is simultaneously prevented. The transport of the aerosol toward the web and adherence thereto can be substantially improved by applying an electric field at the atomizing zone. The length of the atomizing zone in the machine direction and the magnitude of applied ultrasonic vibrating power may be varied by means of adjacently disposed atomizer modules. Correspondingly, the cross-machine profile of the applied coat weight may be adjusted by controlling the input power to the transducer elements. The transducers need not necessarily be attached to a separate atomizing plate, but instead, the aerosol generation may occur directly from the vibrated surface of the transducers. In this case the admission of the coating mix onto the atomizing surfaces becomes difficult due to the required seals and similar arrangements. The aerosol is normally generated using ultrasonic vibrating frequencies, that is, frequencies above 10–20 kHz. In special cases, lower frequencies may instead be used when large droplet size is desired.

In accordance with the present invention, magnetostrictive transducer elements can also be used for generating vibrating energy.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A method for applying a coating mix onto a moving paper or board web comprising:

supplying a flowing stream of a coating mix;

passing the stream of coating mix over a planar surface having a portion positioned proximate to substantially parallel to and below a portion of a moving paper or board web; and causing the portion of the planar surface to vibrate sufficiently to cause a portion of the stream of coating mix passing over the portion of the planar surface to atomize into an aerosol, to be emitted from the stream of the coating mix, and to travel upward to and adhere to the portion of the moving web, the aerosol being emitted, traveling upward to and adhering to the portion of the moving web without the use of a jet of air to cause the aerosol to be so emitted, to so travel and to so adhere.

2. The method of claim 1, wherein the portion of the moving web is supported by a roller.

3. The method of claim 1, wherein the portion of the moving web is supported by a wire.

4. The method of claim 1, wherein the portion of the planar surface is vibrated at a frequency above 10 kHz.

5. The method of claim 1, wherein the portion of the planar surface is vibrated at a frequency between 25 kHz and 60 kHz.

6. The method of claim 1, wherein the stream of coating mix passes over the portion of the planar surface in a laminar flow.

7. The method of claim 1, further comprising applying an electric field in a region proximate to the portion of the planar surface such that the aerosol travels toward the moving web.

8. The method of claim 1, further comprising controlling the depth of the stream of the coating mix to the portion of the planar surface.

9. The method of claim 1, further comprising controlling a distance between the stream of the coating mix and the web.

10. The method of claim 1, wherein the portion of the planar surface is caused to vibrate by a plurality of transducer elements upon application of energy to the plurality of transducer elements.

11. The method of claim 10, wherein the transducer elements are piezoelectric transducers.

12. The method of claim 10, wherein a beam extending across a width of the planar surface is interposed between the plurality of transducer elements and the portion of the planar surface.

* * * * *